US008192005B2

(12) United States Patent
Law et al.

(10) Patent No.: US 8,192,005 B2
(45) Date of Patent: Jun. 5, 2012

(54) ROLLERS FOR PHASE-CHANGE INK PRINTING

(75) Inventors: Kock-Yee Law, Penfield, NY (US); Paul John McConville, Webster, NY (US); James Edward Williams, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 462 days.

(21) Appl. No.: 12/511,179

(22) Filed: Jul. 29, 2009

(65) Prior Publication Data

US 2011/0025791 A1 Feb. 3, 2011

(51) Int. Cl.
*B41J 2/01* (2006.01)

(52) U.S. Cl. ..... 347/88; 347/99; 347/103

(58) Field of Classification Search ..... 347/88, 347/99, 101, 103, 105
See application file for complete search history.

(56) References Cited

U.S. PATENT DOCUMENTS

| | | | | |
|---|---|---|---|---|
| 6,113,231 | A * | 9/2000 | Burr et al. | 347/103 |
| 6,196,675 | B1 | 3/2001 | Deiley et al. | |
| 6,390,961 | B1 | 5/2002 | Nakada et al. | |
| 6,494,570 | B1 * | 12/2002 | Snyder | 347/103 |
| 6,527,386 | B1 * | 3/2003 | Blank et al. | 347/103 |
| 7,127,990 | B2 | 10/2006 | Langsch et al. | |
| 7,328,976 | B2 | 2/2008 | Silverbrook | |
| 7,419,257 | B2 * | 9/2008 | Mouri et al. | 347/103 |
| 7,494,213 | B2 * | 2/2009 | Taniuchi et al. | 347/103 |
| 7,509,084 | B2 | 3/2009 | Gervasi et al. | |
| 7,828,423 | B2 * | 11/2010 | Larson et al. | 347/88 |
| 7,874,664 | B2 * | 1/2011 | Gervasi et al. | 347/103 |
| 2006/0228486 | A1 * | 10/2006 | Facci et al. | 427/421.1 |
| 2008/0050410 | A1 | 2/2008 | Rogers et al. | |
| 2009/0009573 | A1 * | 1/2009 | Larson et al. | 347/88 |
| 2009/0141110 | A1 * | 6/2009 | Gervasi et al. | 347/100 |

FOREIGN PATENT DOCUMENTS

| | | |
|---|---|---|
| DE | 3929642 | 3/1990 |
| EP | 2011659 | 1/2009 |
| WO | 0194121 | 12/2001 |

OTHER PUBLICATIONS

European Search Report corresponding to European Patent Application 10170361.9, European Patent Office, Rijswijk, Netherlands, Oct. 12, 2010 (6 pages).

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A printer for transferring a phase-change ink onto a substrate includes components for conveying the substrate along a path through the printing machine, a printing station including a plurality of printheads disposed along the path and configured to transfer the phase-change solid ink onto the substrate as it is conveyed along the path, a plurality of metal backing rollers facing the plurality of printheads and arranged to support to the substrate passing between the backing rollers and the printheads, and a spreader station receiving the substrate from the printing station and configured to spread the phase-change solid ink on the substrate, the spreader station including a spreader roller and a metal pressure roller opposing the spreader roller. Each of the non-oiled metal rollers includes a coating that is oleophobic that has low adhesion toward the solid ink image but sufficient lateral friction as to not slide against the ink or paper web.

12 Claims, 1 Drawing Sheet

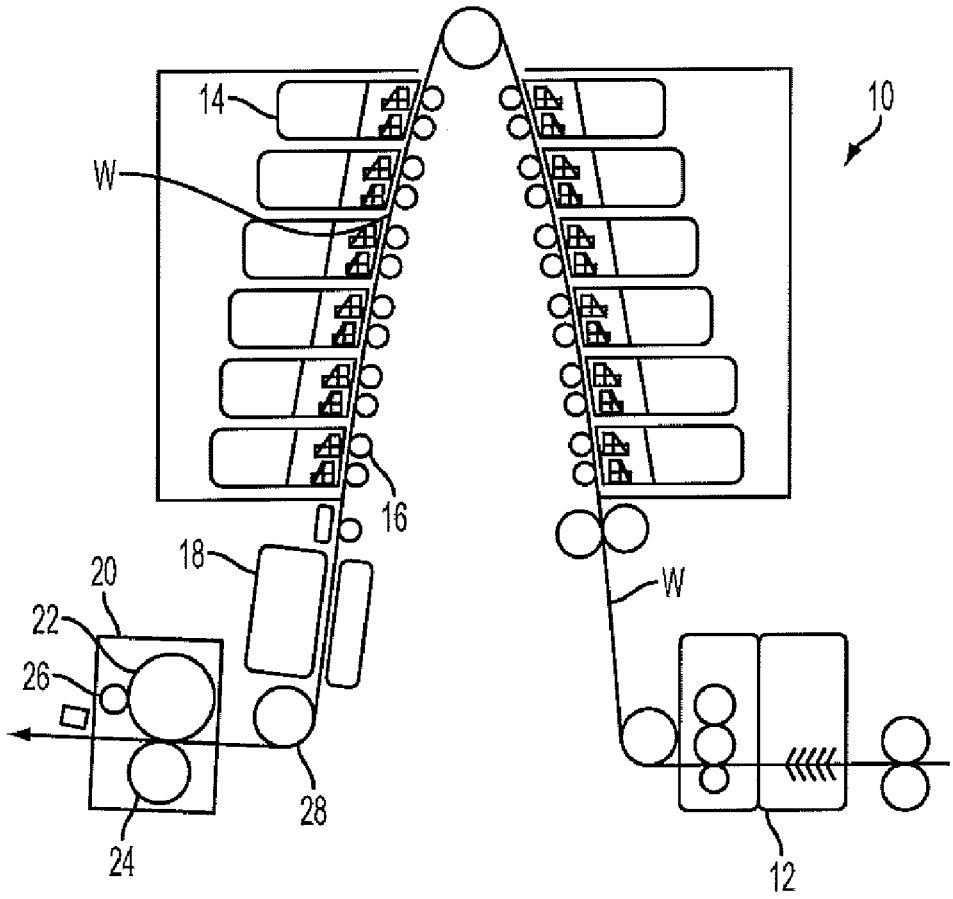
14
10
W
16
18
20
22
26
W
28
24
12

ROLLERS FOR PHASE-CHANGE INK PRINTING

TECHNICAL FIELD

The present disclosure relates to ink-jet printing, particularly involving phase-change inks printing on a substantially continuous web.

BACKGROUND

Ink jet printing involves ejecting ink droplets from orifices in a print head onto a receiving surface to form an image. The image is made up of a grid-like pattern of potential drop locations, commonly referred to as pixels. Ink-jet printing systems commonly utilize either a direct printing or offset printing architecture. In a typical direct printing system, ink is ejected from jets in the print head directly onto the final receiving web. In an offset printing system, the image is formed on an intermediate transfer surface and subsequently transferred to the final receiving web. The intermediate transfer surface may take the form of a liquid layer that is applied to a support surface, such as a drum. The print head jets the ink onto the intermediate transfer surface to form an ink image thereon. Once the ink image has been fully deposited, the final receiving web is then brought into contact with the intermediate transfer surface and the ink image is transferred to the final receiving web.

U.S. Pat. No. 5,389,958, assigned to the assignee of the present application, is an example of an indirect or offset printing architecture that utilizes phase change ink. The ink is applied to an intermediate transfer surface in molten form, having been melted from its solid form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving web, such as a sheet of media, is then fed into the transfer nip and the ink image is transferred to the final receiving web.

One form of direct-to-sheet, continuous-web, phase-change solid ink printer is disclosed in pending application Ser. No. 11/773,549, filed on Jul. 5, 2007, and published as U.S. No. 2009/0009573, assigned to the assignee of the present application, which disclosure is incorporated herein by reference One embodiment of a direct-to-sheet printer is depicted in FIG. 1. In this printer, a substantially continuous web W or "substrate" (such as paper, plastic, or other printable material) is conveyed through a path by a series of conveying components, such as rollers. The path includes a pre-heater 12 that brings the web to an initial predetermined temperature. The web W is conveyed by the components through a printing station 10 that includes a series of printheads 14 configured to place a phase-change ink of one primary color directly onto the moving web.

The ink directed onto web is a solid "phase-change ink," by which is meant that the ink is substantially solid at room temperature and substantially liquid when initially jetted onto the web W. Common phase-change or solid inks are typically heated to about 100° C. to 140° C., and thus in liquid phase, upon being jetted onto the web. Generally speaking, the liquid ink cools down quickly upon hitting the web W.

Associated with each printhead is a backing member 16, typically in the form of a bar or roller, which is arranged substantially opposite the printhead 14 on the other side of and supporting the web W. Each backing member 16 can be heated and controlled, in combination with the pre-heater, to cause the adjacent portion of the web to reach a predetermined "ink-receiving" temperature, for instance about 40° C. to about 70° C. The phase-change or molten solid ink is jetted at a temperature typically significantly higher than the receiving web's temperature, often in the range of 100-140° C., so in some cases the web temperature is further controlled by utilizing air blowers or fans behind the web in the printing station.

Following the printing station the web is conveyed along the path by a series of tension rollers, followed by one or more "mid-heaters" 18. The mid-heaters bring the ink placed on the web to a temperature suitable for desired properties when the ink on the web is sent through a subsequent "spreader" component 20. The spreader component 20 applies a predetermined pressure, and in some implementations heat, to the web to take what are essentially isolated droplets of ink on the web and smear them out to make a continuous layer by pressure. The spreader typically includes opposing rollers, such as an image-side roller 22 and a pressure roller 24. In one practical embodiment disclosed in the aforementioned application Ser. No. 11/773,549, the nip pressure between the two rollers is set in a range of about 500 to about 2000 psi lbs/side. Lower nip pressure gives less line spread while higher nip pressure may reduce roller life.

The spreader may also include a cleaning/oiling station 26 associated with image-side roller that is suitable for cleaning and/or applying a layer of some lubricant or other material to the roller surface. Such a station 26 coats the surface of the spreader roller with a lubricant such as an amino silicone oil having viscosity of about 10-200 centipoises. Following the spreader, some printers include a "glosser", whose function is to change the gloss of the image or impress a desired surface texture. In certain machines that permit duplex printing, a turn roller 28 may be provided between the mid-heater and the spreader, as well as at the beginning of the printing path. In a certain printer, twenty-four backing rollers 16 and two turn rollers 28 are provided.

In a typical direct printing machine, the pressure rollers 24 are formed of a relatively soft material with a durometer anywhere from about 50 D to about 65 D, with elastic moduli from about 65 MPa to about 115 MPa. In contrast, the opposing image side rollers 22 that contact the inked side of the web are typically formed of a relatively hard material, such as a metal. In certain embodiments the rollers 22 are formed of anodized aluminum. Similarly, the backing rollers 16 and the turn rollers 28 are formed of the same material, namely anodized aluminum.

Each of the anodized aluminum rollers is in contact with spread and un-spread sold ink images depending upon their location in the printing path and on whether the process is simplex or duplex. It is desirable in any printing machine to minimize the amount of ink that is offset from the substrate or web onto the rollers. In printer architectures such as described above, ink offset onto an aluminum roller will occur when the adhesive force between the ink image and the roller is stronger than the cohesive force within the ink image itself. One approach to minimizing ink offset is to maintain the rollers at a relative low temperature, in the neighborhood of 30° C. Since the temperature of the ink itself is much higher than this desired temperature, cooling fans are necessary to reduce the web and ink temperature at the printing stations. The web and ink temperature must then be increased to around 60° C. at the spreader for optimal spreading of the ink onto the web. The result is a process with a narrow range of operation that can be energy inefficient.

Consequently, there is a need for a roller construction that reduces the risk of ink offset onto the roller under conditions that optimize the printing process and energy efficiency of the process. There is also a need for low adhesion coatings that show little affinity or have low adhesion towards the solid ink image.

SUMMARY

According to one aspect, a printing apparatus includes a plurality of rollers in contact with ink images on a substrate, the surface of the rollers including a coating that exhibits little adhesion toward the solid ink image.

A printing machine or printer for transferring a phase-change ink onto a substrate comprises components for conveying the substrate along a path through the printing machine, a printing station including a plurality of printheads disposed along the path and configured to transfer a phase-change solid ink onto the substrate as it is conveyed along the path, and a plurality of metal backing rollers facing the plurality of printheads and arranged to support to the substrate passing between the backing rollers and the printheads. Each of the backing rollers including a coating that exhibits little adhesion toward solid ink. In certain embodiments the coating is also oleophobic, and preferably superoleophobic. In certain embodiments the coating has a hexadecane sliding angle lower than 30 degree. In other embodiments the coating has a sliding angle less than 30 degree with solid ink. The coating can have a thickness of 10 to 100 microns.

The printer may further comprise a spreader station receiving the substrate from the printing station and configured to spread the phase-change solid ink on the substrate. The spreader station includes a spreader roller and a metal pressure roller opposing the spreader roller. The pressure roller may include a low adhesion coating, an oleophobic coating or a superoleophobic coating.

In certain embodiments, the conveying components of the printer are configured to convey the substrate for duplex printing. The components thus include at least one metal turn roller, in which the turn roller may include a low adhesion coating, an oleophobic coating or a superoleophobic coating.

DESCRIPTION OF THE FIGURE

FIG. 1 is a schematic representation of a printer incorporating the coating described herein.

DETAILED DESCRIPTION

The word "printer" herein encompasses any apparatus, such as a digital copier or printer, which performs a printing function. While the present disclosure addresses phase change ink jet applications, other printing techniques may be contemplated where a substrate bearing an ink image passes in contact with pressure or guide components. The pressure or guide components have been described herein as rolls or rollers, although other configurations are contemplated in which a surface contacts the ink image on the substrate. In the embodiment illustrated in FIG. 1, the pressure or guide components include the backing rollers 16, the image side roller 22 and the turn rollers 28. It is contemplated that these rollers are non-oiled rollers within the printer.

One measure of the risk of ink offset for a particular ink material and a particular pressure component is related to the adhesion between the ink material and the surface. Sliding angle is the angle of incline at which a liquid droplet will start to slide when the resting surface is tilted. Sliding angle can be used to measure the adhesion between the liquid droplet and the surface. The smaller the sliding angle the lower the adhesion. When the liquid drop is highly sticky to the surface, the liquid drop will not slide up to 90 degree tilting angle.

A corollary to sliding angle is contact angle, which is the angle at which a liquid/vapor interface meets the solid surface. For a surface that is completely wetted the contact angle is 0°, meaning that the liquid is spread completely over the surface. Conversely, a surface that is completely de-wetted has a contact angle of 180°, meaning that the liquid is in the form of a spherical droplet resting on the surface.

For the aluminum surface of the pressure components described above, the contact angle for water is in the range of 50° to 68°, the contact angle for hexadecane is in the range of ~4° to 6°, and the contact angle for a phase-change ink (measured at ~105° C.) is in the range of 1.6° to 4.2°. The liquid drops or the molten ink do not slide, but flow upon tilting, indicative of stickiness of the ink on the aluminum drum surface. For these aluminum components, the low ink contact angle and the stickiness indicate that the aluminum surface is inadequate to avoid the ink offset problems described above. The risk of ink offset requires strict temperature control throughout the inking process and before the spreader station 20 to increase the ink cohesion. Thus, as explained above, the printed image must be maintained at a temperature of about 30° C. to minimize (but not eliminate) ink offset.

In one embodiment suitable for an organic solid phase-change ink, a low adhesion coating is applied to the pressure or guide components of the printer. In particular, the coating is applied to the non-oiled rollers of the printer, including the backing rollers 16 and turn rollers 28. In some embodiments, the coating may be applied to the pressure roller 24 of the spreader station 20. The coating exhibits low adhesion toward the solid ink image but exhibits sufficient lateral friction as to not slide against the ink or paper web.

As described herein, the low adhesion coating significantly decreases the risk of ink offset, even at higher operating temperatures. As a consequence, the entire printing process can occur at the greater temperature required at the spreader station 20. In the system described above, the mid-heater 18 increases the temperature of the web W to 60° C. to allow the ink to be spread by the spreader drum 22 and pressure roller 24. Thus, with the low adhesion coating disclosed herein, the web W may be maintained at this 60° C. temperature throughout the entire path through the printing station 10. Moreover, the temperature throughout the process need not be as strictly controlled as in prior systems. In some systems, the mid-heater and air circulation components can be eliminated, which reduces the overall energy requirements for the printer. This increased flexibility in temperature control can also allow the use of unheated backing rollers 16, with the web temperature being established by the pre-heater 12 alone. Thus, in certain embodiments, the web W may be pre-heated to a temperature of 100° C. so that as the temperature of the web drops along the printing path it reaches the desired 60° C. temperature at the spreader station 20.

The low adhesion coating disclosed herein exhibits suitable abrasion characteristics for use in a printer to avoid excessive wear on the rotating rollers of the printer. A suitable coating can be made by cross-linking a diisocyanate with a hydroxyl-functionalized polyester in a solvent in the presence of a polysiloxane additive and optimally a fluorolink crosslinker. In one embodiment, these ingredients were formulated into a polyurethane coating solutions and applied onto the surface of an aluminum drum. Suitable techniques for applying the coating include spray, flow and dip. Thin transparent films may be obtained after curing the coating in a heating oven.

Particular embodiments of the coating disclosed herein can be made by mixing a hydroxyl-terminated polyacrylate, Desmophen A870 BA from Bayer Material Science, as component 1, and hexamethylene diisocyanate, Desmodur N-3300A from Bayer Material Science as component 2, in n-butyl acetate. The polysiloxane additive, obtained under the trade name Silclean™ 3700, a hydroxyl functional silicone modified polyacrylate from BYK, was added in varying amounts, typically 2 to 10% by weight relative to the main polymer. After coating and drying at 135 degree C. for 30-60 minutes, the low-adhesion coating disclosed herein can be obtained. Optionally, a fluoro cross-linker, know as Fluorolink, particularly Fluorolink-D from Solvay Solexis, can be added to the coating solution from 0.01 to 5% to increase the contact angle of the final coating. The table below summarizes the data.

| | | Water | | Hexadecane | |
|---|---|---|---|---|---|
| % Silclean | % Fluorolink-D | Contact angle | Sliding angle | Contact angle | Sliding angle |
| 0 (Control) | 0 (Control) | ~70° | ~51° | ~22° | ~90° |
| 2 | 0 | ~93° | ~30° | ~31° | ~5° |
| 8 | 0 | ~100° | ~23° | ~34° | ~2° |
| 2 | 0.5 | | | ~59° | ~21° |
| 2 | 2 | | | ~62° | ~22° |
| 8 | 0.5 | | | ~55° | ~16° |
| 8 | 2 | | | ~62° | ~21° |
| PTFE (comparison) | | ~118° | ~64° | ~48° | ~31° |

The data in the above table for PTFE TEFLON, a well-known low surface energy material, is provided for comparison. Although PTFE TEFLON has fairly high contact angles, the sliding angles are fairly large, indicating that it is not a suitable coating for an aluminum drum for use within a solid-ink printing machine. Indeed, the contact angle and sliding angle for the solid ink under identical conditions are ~63° and 90° for the PTFE TEFLON layer, which indicates that solid ink will stick to that surface.

In specific examples, the contact angle and sliding angle of solid ink on some of the films (at 105 degree C.) were found to be in the range of 50°-80° and 10°-25°, respectively, indicating that the solid ink should have low adhesion to these coatings. The data thus shows that the described coating is oleophobic. In some embodiments is superoleophobic.

The low adhesion coatings disclosed herein may be applied to the pressure components using any suitable technology, including spraying, dipping, flow coating or draw down coating. In certain embodiments, the coatings are applied to a thickness of 10 to 100 microns.

In some embodiments the coating may be superoleophobic. It is contemplated that a superoleophobic coating may require more specialized technology for application to the rollers described above. One such as process is an electrospinning as disclosed in co-pending application Ser. No. 12/511,625, entitled "FABRICATION OF IMPROVED ALUMINUM ROLLERS WITH LOW ADHESION AND ULTRA/SUPER HYDROPHOBICITY AND/OR OLEOPHOBICITY BY ELECTROSPINNING TECHNIQUE IN SOLID INK-JET MARKING", filed concurrently herewith on Jul. 29, 2009, in the name of common inventors.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from others.

What is claimed is:

1. A printing machine for transferring a phase-change ink onto a substrate comprising:

a) components for conveying the substrate along a path through the printing machine;

b) a printing station including a plurality of printheads disposed along said path and configured to transfer a phase-change solid ink onto the substrate as it is conveyed along the path; and c) a plurality of metal backing rollers facing said plurality of printheads and arranged to support to the substrate passing between said backing rollers and said printheads, each of said backing rollers including a surface coating that has low adhesion towards the solid ink.

2. The printing machine of claim 1, wherein said coating is oleophobic.

3. The printing machine of claim 1, wherein said coating is superoleophobic.

4. The printing machine of claim 1, wherein said plurality of backing rollers are heated.

5. The printing machine of claim 1, wherein said coating has a thickness of 10 to 100 microns.

6. The printing machine of claim 1, wherein said the low adhesion coating has a sliding angle lower than 30 degree with hexadecane.

7. The printing machine of claim 1, further comprising a spreader station receiving the substrate from said printing station and configured to spread the phase-change solid ink on the substrate, said spreader station including a spreader roller and a metal pressure roller opposing said spreader roller and configured to apply a nip pressure to the substrate passing there between, said pressure roller including said low adhesion coating.

8. The printing machine of claim 7, wherein said coating is oleophobic.

9. The printing machine of claim 7, wherein said coating is superoleophobic.

10. The printing machine of claim 7, wherein said coating has a thickness of 10 to 100 microns.

11. The printing machine of claim 7, wherein said low adhesion coating has a sliding angle lower than 30 degree with hexadecane.

12. The printing machine of claim 1, wherein:

said components for conveying are configured to convey the substrate for duplex printing, said components including at least one metal turn roller, said turn roller including said low adhesion coating has a sliding angle lower than 30 degree with hexadecane.

* * * * *